United States Patent [19]

Anderson

[11] 4,259,878

[45] Apr. 7, 1981

[54] HAND CONTROL MECHANISM

[75] Inventor: John F. Anderson, Cuba City, Wis.

[73] Assignee: Deere & Company, Moline, Ill.

[21] Appl. No.: 89,280

[22] Filed: Oct. 29, 1979

[51] Int. Cl.[3] ..... G05G 7/00

[52] U.S. Cl. ..... 74/491; 74/417; 74/471 XY; 74/507

[58] Field of Search ..... 74/417, 491, 471 XY, 74/507

[56] References Cited

U.S. PATENT DOCUMENTS

| | | | |
|---|---|---|---|
| 1,393,678 | 10/1921 | Falk | 74/507 X |
| 1,454,726 | 5/1923 | Collins | 74/507 X |
| 3,997,040 | 12/1976 | O'Neill et al. | 74/491 X |
| 4,126,056 | 11/1978 | Brown et al. | 74/491 |
| 4,126,987 | 11/1978 | Sarich | 56/208 |
| 4,140,027 | 2/1979 | Wineburner et al. | 74/471 R |
| 4,140,200 | 2/1979 | Tucek | 74/471 XY X |

*Primary Examiner*—Allan D. Herrmann

[57] ABSTRACT

The hand control mechanism has the ability to receive two alternative modes of input for the given mode of output. The mechanism includes a handled lever extending into a housing rotatably mounted to a frame, and a bell crank rotatably mounted to said housing. The handled lever can be moved longitudinally to a first or second position. The first position communicates the lever to a plurality of gears such that rotating the lever about its longitudinal axis rotates the bell crank about the housing. Placing the lever in the second position the bell crank is restrained from rotating free of the housing which can be rotated directly by the lever, rotation of the bell crank being the assigned mode of output.

8 Claims, 3 Drawing Figures

HAND CONTROL MECHANISM

BACKGROUND OF THE INVENTION

This invention relates to lever mechanisms and, more particularly, to a single lever mechanism capable of receiving alternative modes of input for a given mode of output.

It is often desirous to employ in material handling vehicles, such as crawler dozers or the like, a single lever control capable of receiving alternative mode of input to control different working elements of a vehicle. The desirability of such levers is enhanced in the interest of spacial efficiency when the lever is to be placed on a control console within the cab compartment of the vehicle. Conventional levers capable of receiving alternative mode of input are not well suited for console mounting because of their spacial requirements.

The present invention presents a lever control mechansim capable of receiving alternative modes of input for a given output, well suited for console mounting.

SUMMARY OF THE INVENTION

The lever control mechanism consists of the housing which has bores machined therein in three intersecting axial directions (X, Y, Z). Into the bore along the Y axis is placed a portion of a handled lever which has a double detented area. A needle bearing and wiper seal is placed around the handled lever to each side of the detented area within the housing which allows the handled lever to freely rotate about its longitudinal axis as well as experience longitudinal motion without the introduction of contaminants inside the housing. Into the housing bore along the Z axis on each side of the lever is a steel ball followed by a spring, a locking nut, and an adjustable setscrew so arranged such that the steel balls will so cooperate with the double detented area of the lever to limit the lever to two longitudinal positions within the housing. Into the bore on the X axis to each side of the handled lever is press sealed a needle bearing supported by two screws which anchor into a support mount, which allows the complete housing assembly to freely rotate about its X axis on the support mount, the support mount being mounted to a vehicle console sub-structure. Non-ferrous washers are placed between the housing and support mount to ensure that corrosion does not fuse the housing and support mount together. Pressed onto the housing is a ball bearing carrying a bell crank which has fixably mounted thereto a bevel gear. In constant mesh with the bevel gear is a pinion gear mounted in a ball bearing placed in the base of the support mount.

With the lever in its lower detented position a pin on the end of the lever fits within a groove in the pinion gear such that by rotating the lever about its longitudinal axis the pinion gear is rotated about the Y axis which in turn rotates the bevel gear and bell crank to drive a linked rod longitudinally. With the lever in its upper detent position the pin locks the bell crank and housing together as a unit such that the lever can be moved fore-and-aft in an arc to cause the bell crank to drive the linking rod longitudinally. The linking rod can be selectively communicated to the vehicle's work elements by a selector valve located down line of the linking rod.

It is an object of the present invention to reveal a lever control mechanism capable of receiving alternative forms of input for a given mode of output, the lever control mechanism to be particularly suited for deployment on a vehicle console.

DETAILED DESCRIPTION OF THE PREFERRED EMBODIMENT

Figure 1:
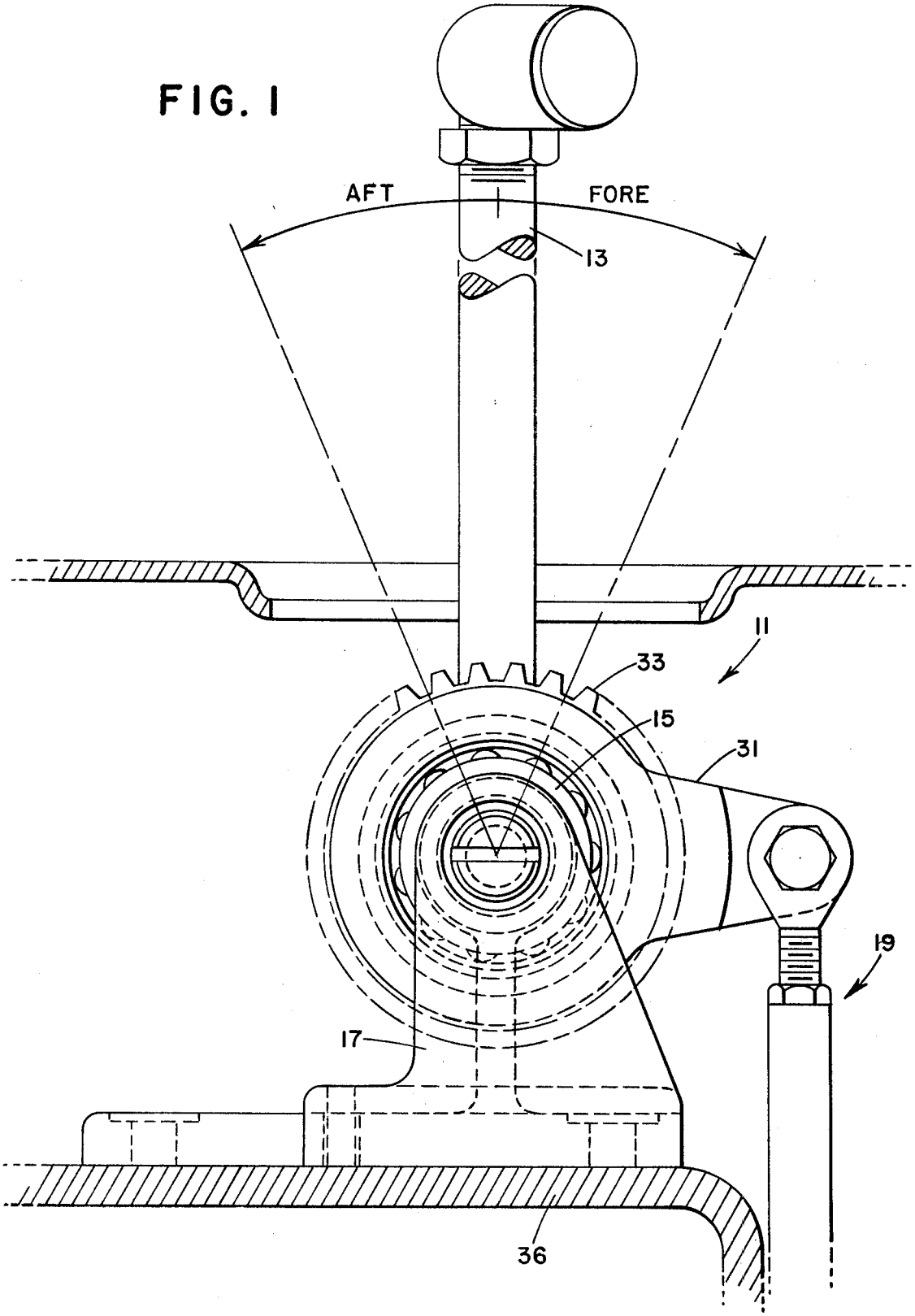
FIG. 1 is a side view of the lever mechanism embodying the present invention.

Referring to FIG. 1, a lever control mechanism generally indicated as 11, includes a handled lever 13 mounted in a housing 15 rotatably maintained by a support mount or assembly 17. The lever control mechanism 11 communicates with a rod assembly 19 being linked to alternative vehicle function of the carrying vehicle downline of assembly 19 by any conventional means such as a selector valve (not shown). By way of illustration, the lever control mechanism may be employed on an angle dozer to control the dozer blade angle and positioning of the dozer ripper.

Figure 2:
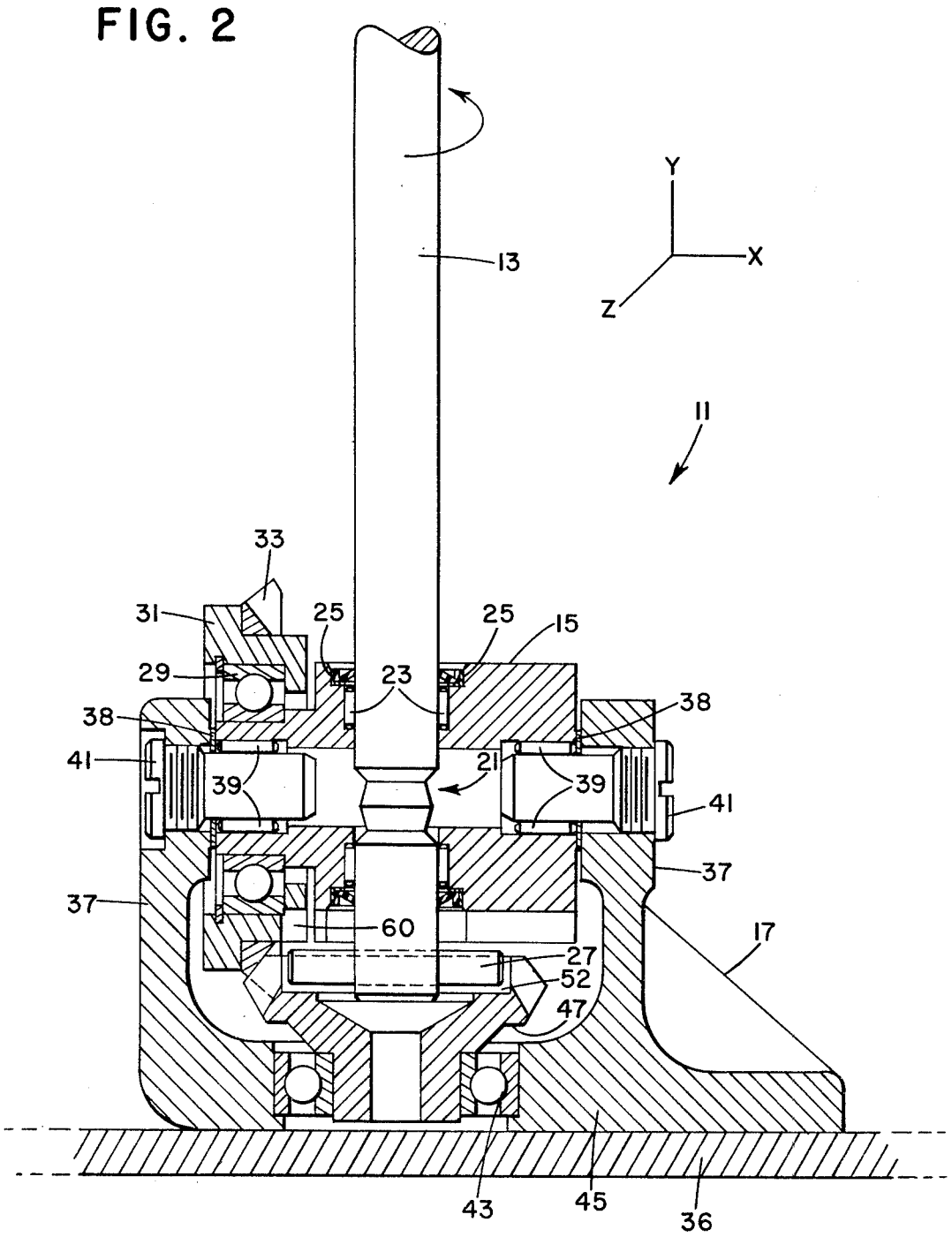
FIG. 2 is a sectioned side view along the X, Y plane.

Referring to FIG. 2, the housing 15 has three linear bores placed therein in intersecting axial alignment (X, Y, Z). The handled lever 13 has a double detented area 21, the lever 13 being placed within the housing bore along the Y axis such that the double detented area 21 is within the housing 15. Placed to each side of the detented area 21 within the housing 15 is a needle bearing 23 followed by a wiper seal 25 pressed within the bore thereby allowing the handled lever 13 to rotate freely about its Y axis and move in the longitudinal direction while preventing contaminants from entering the housing 15. Fixably mounted by any conventional means within the handled lever 13 in close proximity to one end of lever 13 and extending generally perpendicular therefrom is a pin 27. A bearing 29 is fixably mounted to one side of the housing to rotatably carry a bell crank 31 on the housing 15. Bell crank has fixably mounted therearound a bevel gear 33.

A support mount 17 contains opposing side walls 37 having a bore through each side wall 37, the bores in side walls 37 being co-linear. The housing 15 is placed between side wall 37 of support mount 17 and rotatably maintained therebetween. A needle bearing 39 is press sealed within the housing 15 bore along the X axis to each side of handled lever 13. A washer 38 is placed between each side wall 37 and the housing 15 and a set screw 41 is passed through the bore in each side wall 37 of support mount 17 into the needle bearing 39 to permit free rotation about the X axis of the housing, the support mount 17 being fixably mounted to the substructure of a vehicle console generally indicated as 36. A bearing 43 is also fixably mounted to the support mount 17 within the base 45 wherein a slotted pinion gear 47 is rotatably maintained and aligned to receive pin 27 mounted on handled lever 13. Pinion gear 47 is in constant mesh with bevel gears 33 mounted on the bell crank 31.

Figure 3:
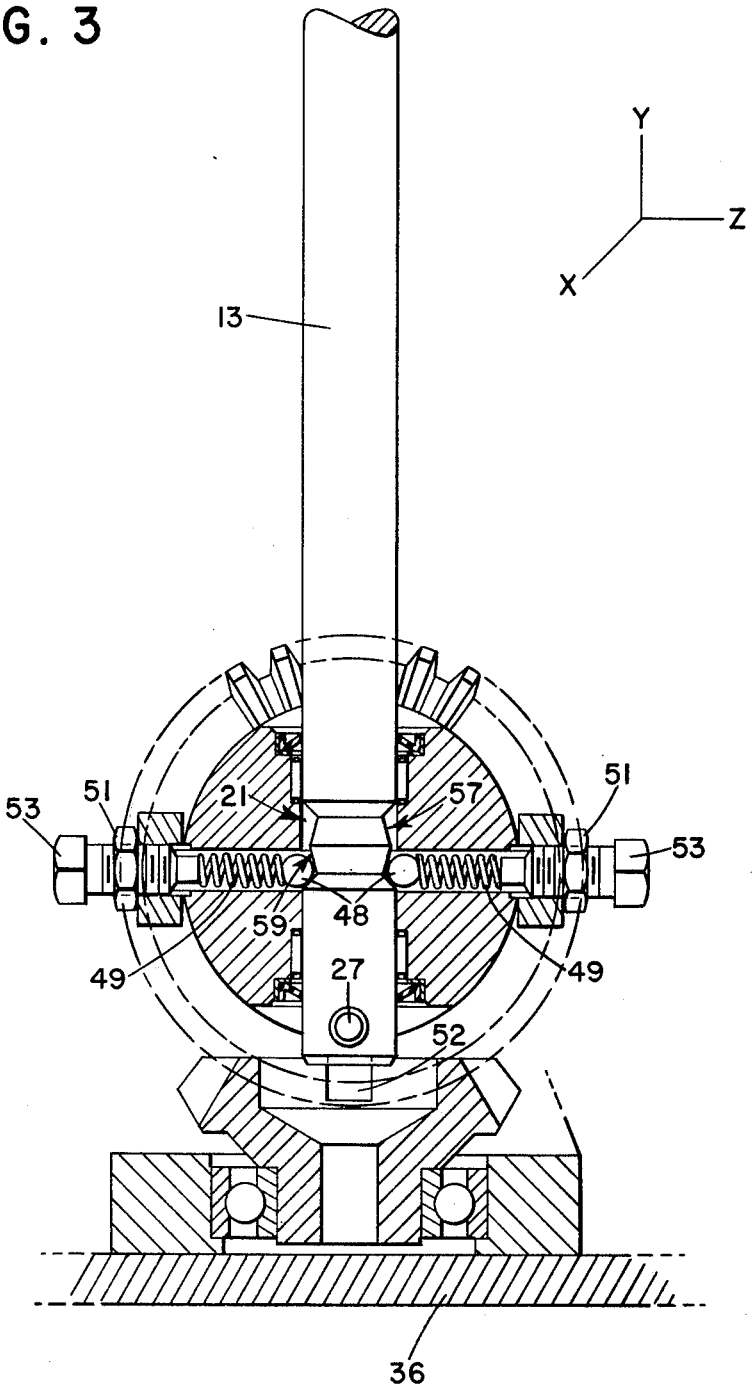
FIG. 3 is a sectioned side view along the Y, Z plane.

Referring to FIG. 3, within each bore in the housing 15 along the Z axis is a spherical member 48 followed by a spring 49, locking nut 51, and an adjusting setscrew 53. The spherical members 48 are sized and placed within the housing based by springs 49 to fit within either the first or second adjacent detends 57 or 59, respectively, of the double detent area 21 and cooperate with the housing bore along the Z axis, such that, longitudinal motion of lever 13 is limited to a corresponding first and second detent or lever position. When the handled lever 13 is in a first detent position as shown in FIG. 2, the pin 27 is within a slot 52 on pinion gear 47 mounted within the base 45 of the support mount 17, such that, by rotating the handled lever 13 about the Y axis the pinion gear 47 turns the bevel gears 33 mounted to the bell crank 31, to allow the bell crank 31 to arc and withdraw the rod 19 mounted thereto, the housing 15 is not permitted to rotate because of the fit of pin 27 within the pinion gear 47. When the handled lever 13 is raised to a second detent position as shown in FIG. 3 disengaging pin 27 from the pinion gear 47, the pins 27 fit within a groove 60 on the bell crank 31, thereby not permitting the handled lever 13 to rotate and also allowing the handled lever to arc and by so doing causing the housing 15 and bell crank 31 to arc again withdrawing the rod 19.

The aforedescribed represents the preferred embodiment of the present invention and in no way should be taken as limiting the scope of the invention. The full scope of the invention being defined by the following claims.

I claim:

1. A handled lever mechanism to receive alternative modes of input to derive a single mode of output communicated to linking assembly, comprising;

(a) a support mount;

(b) a housing rotatably mounted to said support mount;

(c) a lever partially mounted within said housing and mounted therein such that said lever can experience longitudinal motion and rotate about said lever's longitudinal axis, said lever to be mounted to said housing such that said lever can cause said housing to rotate with respect to said support mount;

(d) first means rotatably mounted to said housing for providing a means of communicating motion of said lever to said linking assembly;

(e) second means to limit the longitudinal motion of said lever to a first and second lever position;

(f) third means for translating said rotation of said lever about said lever's longitudinal axis to an arc motion of said first means when said lever is in said first position;

(g) fourth means for allowing motion of said lever in an arc path to result in motion of said first means and said housing in an arced path when said lever is in a second position;

(h) fifth means for not allowing said housing to rotate when said lever is in said first position.

2. A handled lever as claimed in claim 1 further comprising a sixth means for not allowing said lever to rotate when said lever is in said second position.

3. A handled lever as claimed in claim 1 wherein said first means is a bell crank rotatably mounted on said housing;

4. A handled lever as claimed in claim 1 wherein said second means comprises;

(a) a spherical member placed within a bore in said housing said bore being generally perpendicular to said lever portion within said housing, said spherical member being sized to cooperatively fit within a first or second adjacent detent on said lever portion within said housing, said spherical member cooperating with said first and second detent and said housing wall defining said bore to limit longitudinal motion of said lever between said lever detents, said first and second detent positions defining said first and second longitudinal lever position, respectively;

(b) a spring placed within said bore biasing said spherical member; and, (c) means for maintaining said spring in biasing influence on said spherical member.

5. A handled lever as claimed in claim 1 wherein said third means, comprises;

(a) a pinion gear rotatably mounted in said support mount;

(b) a bevel gear fixably mounted to said first means in constant mesh with said pinion gear such that rotation of said pinion gear causes said bevel gear to rotate said first means;

(c) communicating means for communicating said rotation of said lever about its longitudinal axis to cause rotation of said pinion gear.

6. A handled lever as claimed in claim 5 wherein said communicating means is comprised of a pin fixably mounted to said lever portion within said housing extending generally perpendicular from said lever and sized to be received by said pinion gear within a groove therein when said lever is in said second position.

7. A handled lever to receive alternative modes of input to derive a single mode of output, comprising;

(a) a support mount having a base and opposing side walls;

(b) a housing rotatably mounted between said opposing side walls of said support mount;

(c) a lever partially mounted within said housing and mounted therein such that said lever can experience longitudinal motion as well as rotational motion about said lever's longitudinal axis, said lever to be mounted within said housing such that said lever can be moved from a neutral position in an arced path to cause said housing to rotate;

(d) a bell crank rotatably mounted on said housing;

(e) first means for limiting longitudinal motion of said lever to a first and second lever position;

(f) a pinion gear rotatably mounted in said base of said support mount co-linear to said lever when said lever is in said neutral position;

(g) a bevel gear fixably mounted to said bell crank in constant mesh with said pinion gear such that rotation of said pinion gear causes rotation of said bevel gear which in turn rotates said bell crank;

(h) a pin fixably mounted to said lever portion within said housing extending generally perpendicular from said lever and sized to be received by said pinion gear within a groove therein when said lever is in said second position and to be received by said bevel gear within a groove therein when said lever is in said first position, whereby, when said lever is in said neutral and first position said placement of said pin within said groove in said pinion gear prevents said housing from rotating, and when said lever is in said second position said pin within said groove on said bevel gear prevents said lever from rotating about said lever's longitudinal axis.

8. A handled lever as claimed in claim 7 wherein said first means comprises;

(a) a spherical member placed with a bore in said housing said bore being generally perpendicular to said lever portion with said housing, said spherical member being sized to cooperatively fit within a first or second adjacent detent on said lever portion within said housing, said spherical member cooperating with said first and second detents and said housing defining said bore to limit longitudinal motion of said lever between said lever detent, said first and second detent positions defining said first and second lever position;

(b) a spring placed within said bore biasing said spherical member; and (c) means for maintaining said spring in biasing influence on said spherical member.

* * * * *